US005222627A

United States Patent [19]

Coleman et al.

[11] Patent Number: 5,222,627

[45] Date of Patent: Jun. 29, 1993

[54] CANDY HOLDING DISPENSING DEVICE

[75] Inventors: Thomas J. Coleman, Bristol; William K. Schlotter, Stafford, both of Va.

[73] Assignee: BAAT Enterprises, Inc., Bristol, Va.

[21] Appl. No.: 896,974

[22] Filed: Jun. 11, 1992

[51] Int. Cl.[5] ..... B23Q 7/04

[52] U.S. Cl. ..... 221/210; 221/312 A

[58] Field of Search ..... 221/210, 219, 220, 312 A, 221/307, 259, 262, 312 R; 294/145, 164, 168

[56] References Cited

U.S. PATENT DOCUMENTS

| | | | |
|---|---|---|---|
| 2,351,514 | 6/1944 | Hutchinson | 221/228 |
| 2,960,259 | 11/1960 | Aveni | 221/229 |
| 2,973,882 | 3/1961 | Jeffus | 221/229 |
| 3,228,555 | 1/1966 | Pinto | 221/312 A |
| 3,942,683 | 3/1976 | Haas | 221/229 |
| 4,749,106 | 6/1988 | von Schuckmann | 221/229 |
| 4,966,305 | 10/1990 | Hinterreiter | 221/229 |
| 5,048,720 | 9/1991 | Hoke | 221/198 |
| 5,080,258 | 1/1992 | Hinterreiter | 221/198 |
| 5,167,327 | 12/1992 | Mondello | 221/312 A |

*Primary Examiner*—Robert P. Olszewski
*Assistant Examiner*—Kenneth Noland

[57] ABSTRACT

This invention relates to novelties and in particular to a hand-held, candy holding/dispensing device designed to hold multiple pieces of candy in a housing. The self-contained candies are loaded in the housing at the factory and can be replaced by the consumer by removing the bottom base or inserting through the top one at a time. The housing has an open end at the top with a perforated plastic shield through which a shaft extends from the bottom of the housing through the top of the housing and is secured into place by a threaded cap at the bottom of the housing. Each piece of candy has a hole through the center to conform to a flexible locking system fixed at the top of the shaft and is loaded onto the top of the shaft by unscrewing the threaded cap at the bottom of the shaft and pulling down until the top of the shaft and the flexible locking system is locked inside the topmost piece of candy. The shaft, along with the attached piece of candy, is then pushed upward through the perforated plastic shield at the top of the cylindrical shaped housing and the threaded cap is then secured to the bottom base. The candy is now ready for consumption and the shaft will be held in place by the threaded end threaded into the bottom base during consumption of the candy. After each piece of candy has been consumed, the candy pieces can be replaced and the candy holding/dispensing device can continue to be used.

16 Claims, 1 Drawing Sheet

CANDY HOLDING DISPENSING DEVICE

This invention is directed to a novelty candy holding/dispensing device and in particular to a candy holding/dispensing device that allows the consumer to load and reload a piece of candy onto a shaft.

It is well known in the prior art that dispensing devices have been made and used in many different ways. It is known in U.S. Pat. No. 3,942,683 that a tablet dispensing receptacle whose housing carries a spring-biased cover is used to dispense an uppermost tablet from the housing; U.S. Pat. No. 2,973,882 is directed to a pocket gum case that dispenses singular pieces of gum via a spring tension housing; U.S. Pat. No. 4,749,106 is directed to a dispensing device for individual portioned dispensing of pastes or the like; U.S. Pat. No. 2,351,514 is directed to a dial shaped dispensing device for dispensing cotton swabs or the like.

All of the above patents make use of a dispenser type of apparatus for some specific purpose.

It is therefore an object of this invention to make use of a candy holding and dispensing device which is designed to hold multiple pieces of candy in a housing from which the candy is dispensed by a consumer of the candy.

Another object of this invention is to provide the consumer a means to load a piece of candy from within a housing onto the end of a shaft for consumption making use of a candy holding and dispenser which is designed to hold multiple pieces of candy within the housing.

Still another object of this invention is to provide the consumer a means to reload a piece of candy stored within a housing onto the end of a shaft after the consumption of a previous piece of candy supported on the shaft.

Yet another object is to provide a relatively inexpensive and uncomplicated novelty device to be enjoyed by young children and adults.

These and other objects will become clearer when related to the description of the drawings.

DETAILED DESCRIPTION

Figure 1:
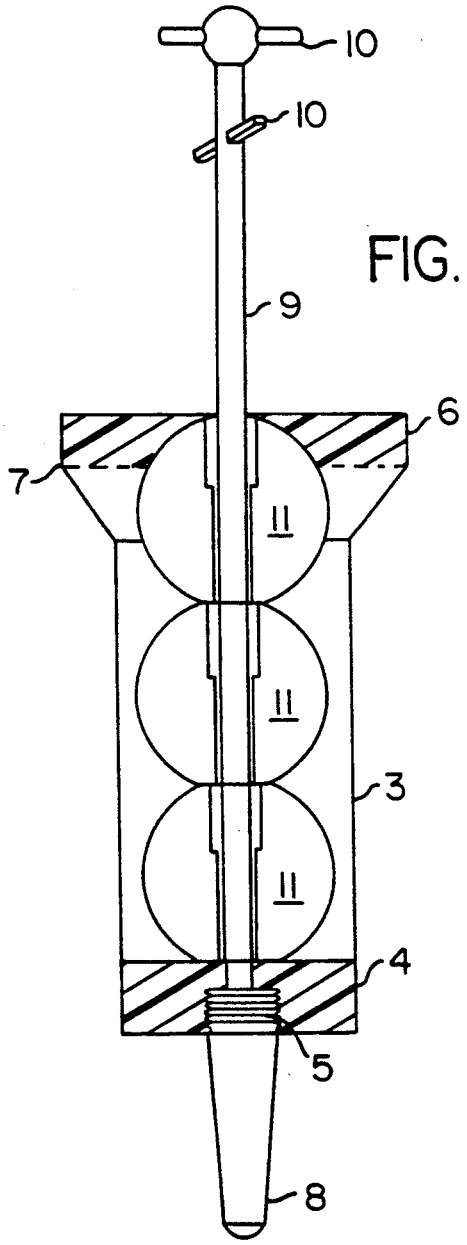
FIG. 1 is a partial cross-sectional view of a novelty candy holding and dispensing device.
Figure 2:
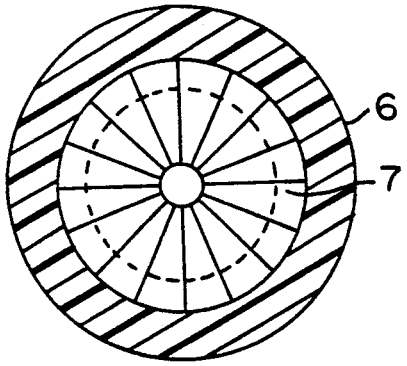
FIG. 2 is a top view of a perforated flexible plastic shield secured by a ring at the top of the candy holding and dispensing device.

Now referring to FIGS. 1 and 2 there is shown an inexpensive candy holding and dispensing device made in accordance with the invention. As shown, the housing (3) which may be a cylindrical shaped housing (3) has a bottom base (4) with a stepped axial aperture having a threaded portion (5) and an unthreaded small portion which functions as a guide for a shaft (9) during reloading a piece of candy onto the shaft. A ring (6) is attached to a flanged upper end of the housing (3). The ring (6) may be pressed into the flanged upper end of the housing or threaded into the upper end in order to secure a perforated plastic shield (7) at the flanged end of the housing (3) for protection of the candy when loaded in the housing. The shaft (9) extends axially through the housing (3) with a lower end extending from the bottom base (4) and an upper end extending from the ring (6). A cap (8) having a threaded end is secured to the lower end of the shaft (9). The upper end of the shaft (9) is provided with axially spaced flexible locks (10) which are perpendicular to each other. The locks may be pieces of rubber or flexible plastic. The threaded cap (8) attached to the shaft (9) screws into the threaded aperture (5) in the base (4) of the housing (3) so that the pieces of candy are held on the shaft when being reloaded and during consumption.

When a person desires to consume a piece of candy, the threaded cap (8) is unthreaded and the shaft (9) is moved downwardly through the plastic shield (7) and the flexible locks (10) are pulled downwardly into the larger aperture in the uppermost piece of candy. The shaft is then pushed upwardly and the cap (8) is secured to the bottom base. The shaft is then held in place and the piece of candy can be consumed. Each successive piece of candy can be loaded onto the shaft (9) in the same manner. The housing can be reloaded with other pieces of candy, when empty, by removing the cap (8) from the shaft (9), then removing the bottom base (4) and leaving the shaft within the housing, the pieces of candy are then pushed onto the shaft and into the housing. The bottom base (4) is then secured to the bottom of the housing and the cap (8) is again threaded into the bottom base until a piece of candy is to be loaded onto the shaft (9). The bottom base (4) may be pressed into the housing with a tight fit or screw threaded onto the end of the housing after originally loading the candy onto a shaft (9) that extends through the housing and upon which the candy is held during consumption.

the housing (3) is loaded with pieces of candy (11) each of which are provided with an axial aperture through which the shaft (9) passes. The pieces of candy can be loaded from the upper or lower end of the housing and then the upper or lower upper and lower end of the housing, the ring (6) and/or the bottom base (4) fixed in place. For a more deluxe model, the end could be provided with threads for removal so that additional candy pieces can be placed in the housing (3) after the original candy has been expended.

The shaft (9) attached to the threaded cap (8) passes through each piece of candy and protrudes through the perforated plastic shield (7) with the upper end of the shaft (9) extending out of the top of the housing (3).

The flexible locking system (10) at the top of the shaft (9) is used to secure one piece of candy (11) at a time during consumption. The shaft (9) can be configured or designed to include any form of locking system (i.e. snap-lock, twist-lock, thread-lock etc. both flexible and non-flexible). Each piece of candy (11) has a hole through the center to conform to the flexible locking system (10) at the top of the shaft (9). The pieces of candy are shown with a stepped aperture. The smaller portion of the aperture is guided on the shaft (9) and the larger aperture portion receives the flexible locks (10).

The holding and dispensing device and candy may be of any shape or size; however, it is desired that the candy be spherical in shape as a well known sucker. The candy (11) and shaft (9) may be covered by a protective wrapper in order to protect the candy and shaft prior to use. The candy is initially loaded into the housing (3) at the point of manufacturing prior to packaging.

The novelty candy holding and dispensing device is sold with the candy already packaged within the housing. In order to expend the piece of candy (11) from the housing (3), for use, the shaft end (8) is unthreaded and the shaft is moved downwardly until the locks (10) are pulled into the upmost candy piece. The locks (10) will grasp the candy piece, then the shaft with the piece of candy is pushed from the housing (3) through the plastic shield (7). Each piece of candy can be expended in this manner.

As set forth above, the candy and dispenser are assembled at the point of manufacture. For a more deluxe model, the bottom base (4) and/or ring (6) can be threaded onto the housing for removal, then additional candy pieces can be placed into the housing (3) once the original pieces have been expended. When loading the candy pieces into the upper end, the threaded cap (8) is removed from the bottom of the shaft and the shaft is removed from the housing from the upper end. The candy is loaded onto the shaft from the lower end of the shaft so that the flexible locks do not pass through the small portion of the aperture in the candy pieces. The shaft with the candy thereon is then forced into the housing and the bottom end of the shaft is locked in place by the threaded cap. The candy is then reloaded and ready for consumption. It is therefore seen that the candy pieces can be loaded from the top or from the bottom of the housing.

The holding and dispensing housing (3) as well as the shaft (9) may be made of any durable material which may be formed or molded into any desired shape. Since the novelty device is to be used by children, the device should have no sharp features. It should be of a so called non-breakage material and non-toxic.

What is claimed:

1. A novelty candy holding and dispensing device which comprises:

a housing, said housing including a bottom end and an upper end, a bottom base in said housing, an axially threaded aperture in said bottom base, a ring at the flanged end of said housing, a perforated plastic shield secured on said upper flanged end of said housing by said ring, a shaft which extends axially through said housing, a threaded cap attached to a bottom end of the shaft and a flexible locking system attached to an upper end of said shaft.

2. A novelty candy holding and dispensing device as set forth in claim 1, wherein; said threaded cap threads onto said bottom base via said threaded aperture, said shaft extends through said threaded aperture in said bottom base which serves as a bushing for stabilization of the shaft in said housing.

3. A novelty candy holding and dispensing device as set forth in claim 1, wherein; said housing includes multiple pieces of candy and each of the said pieces of candy are provided with an axial aperture through which said shaft passes.

4. A novelty candy holding and dispensing device as set forth in claim 2, wherein; said housing includes multiple pieces of candy and each of the said pieces of candy are provided with an axial aperture through which said shaft passes.

5. A novelty candy holding and dispensing device as set forth in claim 3, wherein; said shaft extends through said multiple pieces of candy and through the said perforated plastic shield which is secured by said ring.

6. A novelty candy holding and dispensing device as set forth in claim 4, wherein; said housing includes multiple pieces of candy and each of the said pieces of candy are provided with an axial aperture through which said shaft passes.

7. A novelty candy holding and dispensing device as set forth in claim 3, wherein; said aperture in each said multiple pieces of candy conform to the flexible locking system at the top of said shaft.

8. A novelty candy holding and dispensing device as set forth in claim 4, wherein; said aperture in each said multiple pieces of candy conform to the flexible locking system at the top of said shaft.

9. A novelty candy holding and dispensing device as set forth in claim 1, wherein; said candy is loaded onto said shaft by unscrewing said threaded cap secured to said shaft from said bottom base, said shaft is then pulled downward until said flexible locking system is engaged with the topmost piece of candy thereby securing the topmost piece of candy to the top of said shaft, said shaft, with said piece of candy secured thereon is then pushed upward through said perforated plastic shield at said flanged end of said housing, said threaded cap is then threaded into said bottom base thus securing said shaft firmly in place, said piece of candy is ready for consumption.

10. A novelty candy holding and dispensing device as set forth in claim 9, wherein; each of said multiple pieces of candies within said housing are loaded onto said shaft by repeating the loading procedure.

11. A novelty candy holding and dispensing device as set forth in claim 1, wherein; said bottom base is threaded onto said housing for loading and reloading of pieces of candy.

12. A novelty candy holding and dispensing device which comprises;

a housing, said housing including a bottom end and an upper end, a bottom base in said housing, a shaft that extends through said housing and which protrudes from said upper end, means for securing said shaft to said bottom base, and means on an upper end of said shaft for holding pieces of candy on said shaft during consumption of said candy.

13. A novelty candy holding and dispensing device as claimed in claim 12 in which:

said means for securing said shaft to said bottom base is a threaded cap which is secured to a lower end of said shaft and which is threaded into said bottom base.

14. A novelty candy holding and dispensing device as claimed in claim 13, in which:

said means on the upper end of said shaft for holding pieces of candy on said shaft during consumption of candy is a flexible means which is secured to said shaft.

15. A device as set forth in claim 12, which includes:

pieces of candy in said housing, said pieces of candy include diametrical apertures along an axis of said housing and said pieces of candy surround said shaft, and said aperture in said pieces of candy has a small portion substantially a size of the shaft and an enlarged portion toward the upper end of said housing which receives the means on said upper end of said shaft for holding said candy pieces on said shaft during consumption.

16. A device as set forth in claim 13, in which:

said housing has an upper flanged end, a perforated plastic shield which is secured to said upper flanged end.

* * * * *